United States Patent [19]

Koppelman et al.

[11] Patent Number: 4,477,257

[45] Date of Patent: Oct. 16, 1984

[54] APPARATUS AND PROCESS FOR THERMAL TREATMENT OF ORGANIC CARBONACEOUS MATERIALS

[75] Inventors: Edward Koppelman, Encino; Robert G. Murray, Palo Alto, both of Calif.

[73] Assignee: K-Fuel/Koppelman Patent Licensing Trust, Denver, Colo.

[21] Appl. No.: 449,421

[22] Filed: Dec. 13, 1982

[51] Int. Cl.[3] ..... C10F 5/00; B30B 11/00

[52] U.S. Cl. ..... 44/30; 44/13

[58] Field of Search ..... 44/27-33, 44/11-13, 2; 34/12

[56] References Cited

U.S. PATENT DOCUMENTS

| | | | |
|---|---|---|---|
| 2,573,134 | 10/1951 | Gebauer | 44/28 X |
| 4,126,519 | 11/1978 | Murray et al. | 44/13 X |
| 4,129,420 | 12/1978 | Koppelman | 44/33 X |
| 4,153,420 | 5/1979 | Myreen | 44/27 X |
| 4,213,752 | 7/1980 | Seitzer | 44/33 X |

FOREIGN PATENT DOCUMENTS

| | | | |
|---|---|---|---|
| 216691 | 6/1924 | United Kingdom | 44/27 |
| 228993 | 2/1925 | United Kingdom | 44/27 |
| 665164 | 1/1952 | United Kingdom | 44/27 |

*Primary Examiner*—Carl F. Dees

*Attorney, Agent, or Firm*—Harness, Dickey & Pierce

[57] ABSTRACT

An improved apparatus and method for the continuous processing of organic carbonaceous materials containing appreciable amounts of water to produce thermally upgraded products suitable for use as fuels, carbon-containing chemical intermediates, and the like. The apparatus and process utilizes controlled elevated temperatures and pressures to which the feed material is sequentially subjected including a preheating stage, a pressurized dewatering stage and a reaction stage during which vaporization of at least a portion of the volatile organic and moisture constituents therein is effected to form a gaseous phase. The intervening dewatering stage removes a large proportion of the initial moisture content of the feed material whereby substantially improved efficiency and increased capacity are attained. The gaseous phase generated in the reaction stage is preferably passed in a direction countercurrent to the direction of flow of the feed material in the preheating stage and in heat exchange relationship therewith and residual steam from the preheating stage can also be advantageously employed to preheat and preliminarily reduce the moisture content of the incoming feed material.

48 Claims, 8 Drawing Figures

FIG. 2.
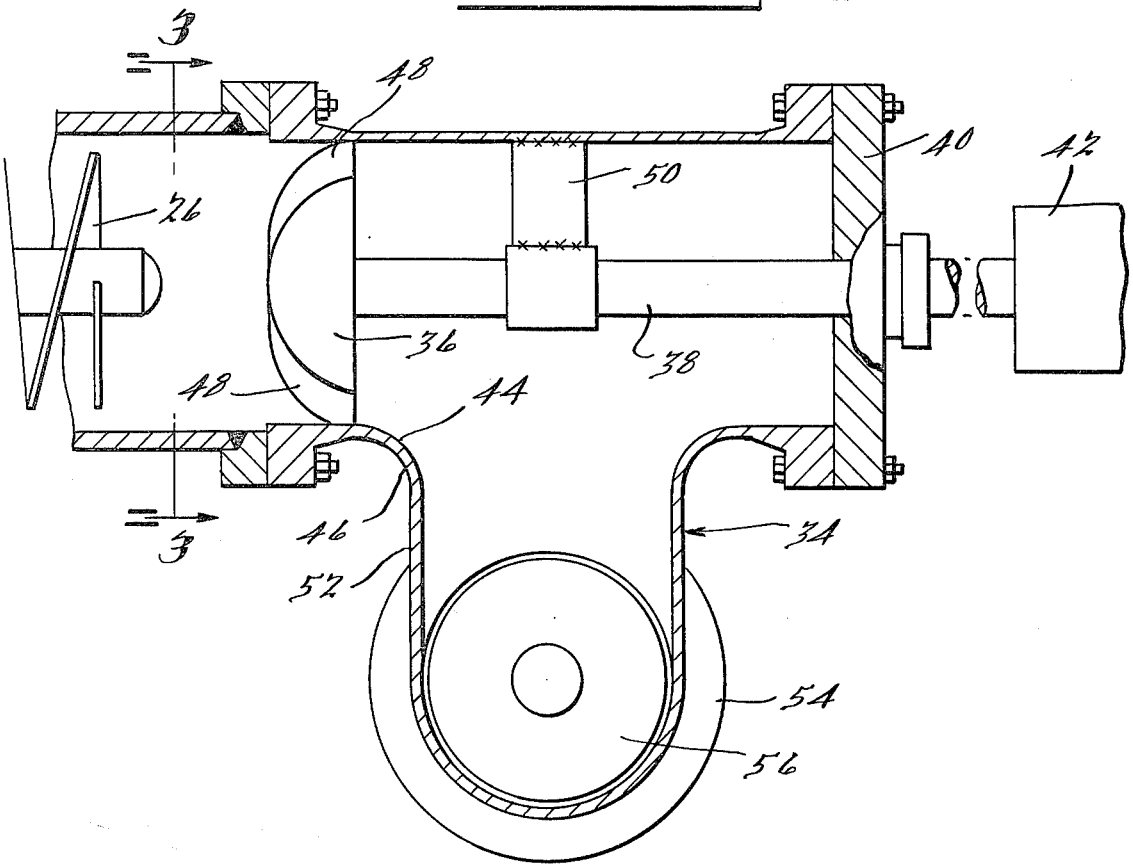
FIG. 3.
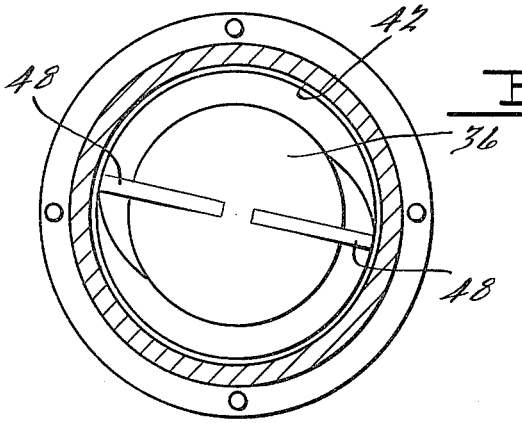
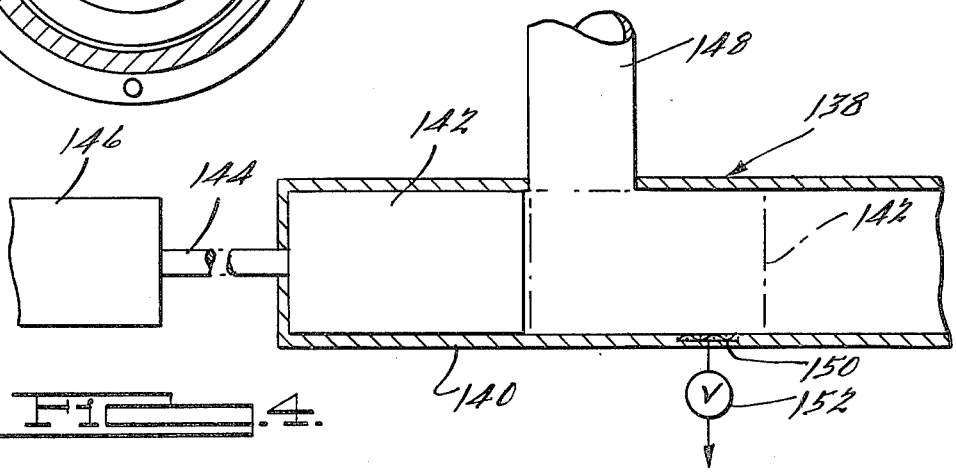
FIG. 4.

APPARATUS AND PROCESS FOR THERMAL TREATMENT OF ORGANIC CARBONACEOUS MATERIALS

BACKGROUND OF THE INVENTION

The improved apparatus and process of the present invention is broadly applicable to the processing of organic carbonaceous materials under controlled pressure and elevated temperatures to effect a desired physical and/or chemical modification thereof to produce the desired product. More particularly, the present invention is directed to the processing of such carbonaceous materials containing appreciable quantities of moisture whereby a substantial reduction in the residual moisture content of the product is effected in addition to a desired thermal chemical restructuring of the organic material to impart improved properties thereto including increased heating values on a dry moisture-free basis.

The shortages and rising prices of conventional energy sources such as petroleum and natural gas have occasioned investigation of alternative energy sources in plentiful supply such as lignitic-type coals, cellulosic materials such as peat, waste cellulosic materials, such as sawdust, bark, wood scrap, branches and chips derived from lumbering and sawmill operations, various agricultural waste materials, such as cotton plant stalks, nutshells, corn husks and the like. Unfortunately, such alternative materials in their naturally occurring state are deficient for one or a variety of reasons for use directly as high energy fuels. For this reason, a variety of processes have been proposed for converting such materials into a form in which their heating value on a moisture-free basis is substantially enhanced, in which they are stable and resistant to weathering during shipment and storage and in which the upgraded fuel product can more readily be adapted for use in conventional furnace equipment.

Typical of such prior processes are those described in U.S. Pat. No. 4,052,168 by which lignitic-type coals are chemically restructured through a controlled thermal treatment providing an upgraded carbonaceous product which is stable and resistant to weathering as well as being of increased heating value approaching that of bituminous coal; U.S. Pat. No. 4,127,391 in which waste bituminous fines derived from conventional coal washing and cleaning operations is treated to provide solid agglomerated coke-like products suitable for direct use as a solid fuel; and U.S. Pat. No. 4,129,420 in which naturally occurring cellulosic materials such as peat as well as waste cellulosic materials are upgraded by a controlled thermal restructuring process to produce solid carbonaceous or coke-like products suitable for use as a solid fuel either by itself or in admixture with other conventional fuels. An apparatus and process for achieving an upgrading of such carbonaceous materials of the types set forth in the aforementioned U.S. patents is disclosed in U.S. Pat. No. 4,126,519 which is assigned to the assignee of the present invention.

In accordance with the teachings of U.S. Pat. No. 4,126,519, the substance of which is incorporated herein by reference, an organic carbonaceous material is introduced in the form of an aqueous slurry which is pressurized and conveyed in a continuous manner from a conveying chamber to a reaction chamber while in countercurrent heat transfer relationship with a gaseous phase generated in the reaction stage to effect a preheating of the feed material. The pressure and temperature in the reaction chamber is controlled in further consideration of the residence time to effect a desired thermal treatment of the feed material which may include the vaporization of substantially all of the moisture therefrom as well as at least a portion of the volatile organic constituents therein while simultaneously undergoing a controlled partial chemical restructuring thereof. The hot reaction mass is retained in a nonoxidizing environment whereafter it is cooled to a temperature at which it can be discharged from the apparatus in contact with the atmosphere.

While the apparatus and method as disclosed in U.S. Pat. No. 4,126,519 has been found eminently suitable for treating organic carbonaceous materials to effect a conversion thereof into improved carbonaceous products, it has been observed that the efficiency and capacity of the system is somewhat limited by the moisture content present in the carbonaceous feed material and that the waste water extracted from the equipment contains dissolved organic constituents some of which are environmentally unfavorable necessitating waste water treatment before they can harmlessly be discharged to waste. While the process produces by-product gases in quantities sufficient to meet the thermal requirements of the process providing a self-sustaining operation, it has further been found that feed materials containing excessive moisture contents detract from the thermal efficiency of processing such materials. The foregoing problems are particularly pronounced in connection with organic carbonaceous materials having inherently high moisture contents, such as for example, peat which in an as-mined or as-dredged condition may contain up to as high as 92 percent by weight moisture. Even when such peat is preliminarily air dried to reduce its moisture content to about 50 percent by weight, the thermal efficiency and output capacity of the processing apparatus are less than optimum from an economical standpoint and have somewhat detracted from a more widespread commercial adaptation of the system.

It is, accordingly, an object of the present invention to provide an improved apparatus and process which is capable of processing carbonaceous feed materials of inherently high moisture content by effecting an efficient in situ reduction in the water content of the input feed stock during processing whereby substantial increases in the thermal efficiency and output capacity of the process are attained with corresponding improvements both in the economical operation of the process itself as well as in any required waste water treatment resulting from the process, thereby further enhancing the commercial adaptation of such equipment and processing techniques as a viable alternative source of energy.

SUMMARY OF THE INVENTION

The benefits and advantages of the present invention in accordance with one embodiment of the apparatus aspects thereof are achieved by an apparatus including a preheating chamber formed with an inlet and an outlet for receiving a moist organic carbonaceous feed material under pressure which is conveyed therethrough and is preheated to a temperature up to about 500° F. to effect a preliminary extraction of moisture therefrom. The preheated feed material is next transferred under pressure into a dewatering chamber formed with an inlet port to receive the preheated feed material through which the feed material is conveyed and compacted to effect a further reduction in the moisture content therein. The dewatering chamber is provided with means for separating the extracted water and dewatered feed material which is discharged through an outlet port in the dewatering chamber under pressure into an entry port of a reaction chamber in which the partially dewatered feed material is subjected to a controlled elevated temperature under a controlled pressure for a period of time to effect vaporization of at least a portion of the volatile substances therein forming a gaseous phase and a reaction product. The reaction product is separated from the gaseous phase and removed through a discharge port into a receiving chamber in which it is cooled and discharged. In accordance with a preferred embodiment of the apparatus, means are provided for transferring the gaseous phase from the reaction chamber to the preheating chamber for countercurrent heat transfer contact with the feed material effecting a preheating thereof.

In accordance with still another embodiment of the apparatus of the present invention, the incoming feed material is confined in a supply hopper to which the residual gaseous phase from the preheating chamber is transferred to effect a preliminary preheating thereof to increase thermal efficiency. For example, if the input feedstock is peat having a starting moisture content of 70–90 percent, this preliminary preheating is believed to increase the heat economy of the system. However, if the peat feedstock has a starting moisture content in the 50 percent range, then it is believed that such preliminary preheating would not affect the heat economy of the system. In either instance, the resultant moisture content of the peat exiting the dewatering chamber would be unaffected. The preliminarily preheated feed material from the storage hopper is transferred under pressure into the preheating chamber to effect a further extraction of moisture therefrom whereafter the preheated feed material is directly transferred under pressure to the reaction chamber for a controlled thermal treatment from which it is ultimately extracted as a reaction product.

If desired, the apparatus of the present invention may comprise an "off-axis" system in which, for example, the rotary screw conveyors employed in the preheating chamber, dewatering chamber and reaction chamber are not all disposed on a common axially extending shaft, or an "on-axis" system in which the above occurs. Each of those arrangements has various counter balancing advantages and disadvantages which must be weighed by the user in ultimately selecting the optimum system to be employed.

In accordance with the process aspects of the present invention, moist organic carbonaceous materials are introduced under pressure into a preheating chamber in which the material is preheated to a temperature of from about 300° to about 500° F. for a period of time to extract a portion of the moisture therefrom whereafter the preheated feed material is separated from the extracted water. The preheated feed material is next introduced under pressure into a dewatering chamber in which the material is subjected to compaction in a manner to expel additional water therefrom which is separated and the dewatered feed material is transferred under pressure into a reaction chamber. The dewatered feed material is conveyed through the reaction chamber and is heated to a temperature of about 400° to about 1200° F. or higher under a pressure ranging from about 300 to about 3000 psi or higher for a period of time usually ranging from as little as about one minute up to about one hour effecting a vaporization of at least a portion of the volatile substances therein forming a gaseous phase and a reaction product. The reaction product is separated from the gaseous phase and the reaction product thereafter is recovered and cooled. In accordance with a preferred embodiment, the gaseous phase derived from the reaction chamber is transferred in countercurrent heat exchange relationship with the incoming feed material in the preheating chamber and the residual gaseous phase from the preheating chamber is further employed for preliminarily preheating the incoming feed material introduced into the process.

When the system or process of the present invention is employed with peat or a similar material as the input feedstock the aforementioned preheating chamber acts as a reaction chamber since the physical characteristics of the input feedstock of moist peat are believed to change so as to enable sufficient moisture to be extracted from the moist peat in the dewatering chamber so as to reduce its moisture content to in the range of about 15 to about 30 percent. Without this reaction which has been observed as occuring when the input moist peat is heated to a temperature in the range of 300° F. to 400° F. in the preheating chamber, further moisture, beyond approximately 70 percent moisture content for the peat cannot be squeezed out of the peat, whether by the presently preferred ram extruder or by a rotary screw-type conveyor extruder. Thus, it has been found that for peat feedstock having a moisture content below approximately 70 percent, no further water extraction can occur without first heating the peat so as to enable a change in its physical characteristics prior to entry into the dewatering chamber. With respect to this heat, it has been found that the heat of vaporization from the reaction chamber can be recovered at a sufficient level from the reaction chamber by countercurrent gas flow from the reaction chamber to the preheating chamber so as to enable the aforementioned change in physical characteristics of the input peat feedstock. In this regard, it has been found that for peat feedstock having a starting moisture content of 70 to 90 percent by weight, a preliminary preheating of the peat prior to entry into the preheating chamber such as to a temperature of 190° F. to 200° F., enhances the heat recovery of the system. This preliminary preheating can be accomplished by a countercurrent gas flow or waste steam injection from the preheating chamber or from an external source into the feed hopper for the peat.

Additional benefits and advantages of the present invention will become apparent upon a reading of the Description of the Preferred Embodiments taken in conjunction with the drawings and specific examples provided.

BRIEF DESCRIPTION OF THE DRAWINGS

FIG. 2 is a fragmentary longitudinal vertical sectional view of a transfer seal for transferring the feed material from the feed extruder to the preheat chamber as shown in FIG. 1;

FIG. 3 is a transverse vertical sectional view of the transfer seal shown in FIG. 2 and taken substantially along line 3—3 thereof;

FIG. 4 is a longitudinal vertical sectional view of a ram-type transfer extruder which can be satisfactorily employed in lieu of a screw-type extruder;

DESCRIPTION OF THE PREFERRED EMBODIMENTS

"OFF-AXIS SYSTEM"

Figures 1, 5:
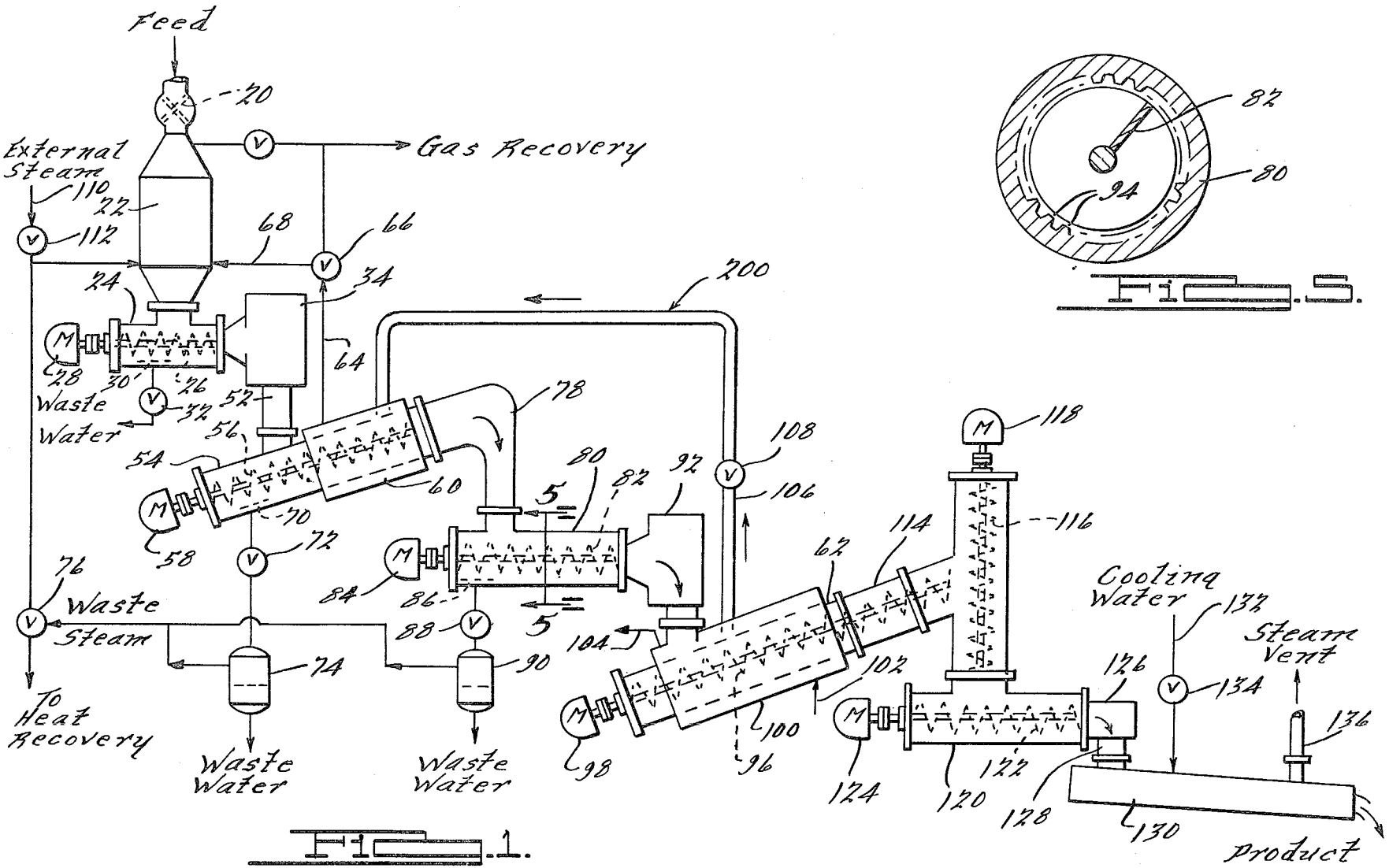
FIG. 1 is a schematic side elevational view of a continuous reaction apparatus constructed in accordance with one of the embodiments of the present invention.
FIG. 5 is an enlarged transverse sectional view of the dewatering chamber of the apparatus shown in FIG. 1 and taken substantially along the line 5—5 thereof.

Referring now in detail to the drawings and as may be best seen in FIG. 1 thereof, a continuous thermal reaction apparatus, generally referred to by the reference numeral 200, for processing moist organic carbonaceous materials is schematically illustrated. In accordance with the arrangement shown, a moist, preferably particulated organic carbonaceous feed material to be processed is introduced into the system 200 by means of a star-type feeder 20 disposed at the upper end of a feed hopper 22 within which the feed material may, if desired, be subjected to a preliminary preheating by incondensable and condensable gases evolved in other stages of the apparatus 200 as will subsequently be described in further detail. The star feeder 20 forms a substantially gas tight seal preventing escape of any such preheating gases. The feed material passes downwardly through the hopper 22 and enters a feed extruder 24 which is preferably of a circular cylindrical configuration and is provided with a screw-type conveyor or auger 26 drivingly coupled to a variable speed motor arrangement 28 such as a hydraulic or electric motor, for example.

The moist feed material is compacted within the feed extruder 24 to a high pressure and a portion of the residual moisture therein is extracted from the feed extruder 24 through a Johnson-type screen 30 in the lower portion thereof which is transferred through a valve 32 to waste treatment.

In order to maintain the desired operating pressure of the apparatus 200 downstream from the feed extruder 24, the outlet or right hand end of the feed extruder 24 as viewed in FIG. 1 is provided with a transfer seal 34 of a type as more clearly illustrated in FIGS. 2 and 3. As shown, the transfer seal 34 incorporates a conical valve member 36 reciprocally supported on a shaft 38 having the end thereof projecting through a flange 40 and coupled to a fluid actuated cylinder 42 to effect a preloading of the valve member 36 to a desired pressure. The diameter of the valve member 36 is less than the internal diameter of a port 44 in a housing 46 of the transfer seal 34 whereby the feed material advanced by the screw conveyor 26 of the feed extruder 24 passes outwardly along the peripheral edge of the valve member 36 in the form of a continuous tube forming a substantially pressure tight seal therebetween. The valve member 36 is retained in substantially centrally disposed position relative to the port 44 by a pair of diametric vanes 48 as well as an intermediate shaft support member 50. The feed material upon passing the valve member 36 passes downwardly through the housing through a conduit 52 and enters a preheating chamber 54 provided with a screw-type conveyor or auger 56 as best seen in FIGS. 1 and 2.

The preheating chamber 54 comprises a circular cylindrical tube which is inclined upwardly as shown in FIG. 1 and is equipped with an insulating jacket 60 along the upper output portion thereof within which the feed material during its conveyance is preheated by a countercurrent flow of hot reaction gases generated in a reaction chamber 62 disposed downstream from the preheating chamber 54. The feed material is preheated to the desired temperature by the transfer of sensible heat from the noncondensable gaseous portion and a liberation of the heat of vaporization of the condensable gaseous portion. In this manner, the predominant portion of heat generated in the reaction zone 62 of the apparatus 200 is recovered in the form of a preheating of the incoming feed material. The residual gaseous phase comprising predominantly noncondensable gases and some condensable gases is advantageously transferred through a conduit 64 equipped with a control valve 66 into the lower section by means of a conduit 68 of the base of the storage hopper 22 to effect a preliminary preheating of the feed stock. Alternatively, all or a portion of the residual gases from the preheating chamber 54 can be transferred to gas recovery for extraction of the valuable constituents therein as well as a source of fuel for heating the reaction chamber 62.

The combination of heating and pressurization imposed on the feed material within the preheating chamber 54 effects a further release and extraction of entrained and chemically combined water therein which is separated and drains downwardly and is removed through a perforated screen 70 through a control valve 72 into a steam separator chamber 74. Any steam generated and separated from the chamber 74 which will vary depending upon the magnitude of preheating to which the feed material is subjected in the preheating chamber 54 can advantageously be transferred through a control valve 76 into the base of the feed hopper 22 to effect a further preheating of the incoming feed material. Alternatively, the steam can be transferred for recovery of the heating value thereof providing for still further efficiency in the operation of the apparatus 200.

The preheated feed material is discharged from the output end of the preheating chamber 54 and passes through a transfer conduit 78 connected to the upper inlet end of a dewatering chamber 80. The dewatering chamber 80 is provided with a rotary screw conveyor 82 drivingly connected to a variable speed motor system 84 for conveying the feed material toward the outlet end thereof. The screw conveyor 82 preferably includes a moderate reducing lead or pitch arrangement, such as one commercially available from the J. C. Steele Company of Statesville, North Carolina, to apply increased pressure to the feed material during its transfer toward the discharge end of the dewatering chamber 80 thereby maximizing the quantity of water extracted from the moist material. The extracted water is separated and is discharged through a perforated screen 86 in the base of the dewatering chamber 80 through a control valve 88 into a steam separation chamber 90. Any steam recovered can advantageously be transferred through the control valve 76 into the base of the storage hopper 22 for effecting a preliminary preheating of the feed material in a manner as previously described in connection with the steam recovered from the preheating chamber 54.

The extracted waste water from the feed extruder 24, the preheating chamber 54 and the dewatering chamber 80 is not contaminated with environmentally undesirable dissolved organic reaction products such as evolved in the separate reaction chamber 62 and therefore can be readily treated such as by ponding or conventional aeration to enable it to be harmlessly discharged to waste. In view of this, a substantial reduction in the waste water treatment and attendant costs are achieved in that only a proportionate smaller quantity of water evolved in the final reaction zone 62 must be subjected to more complex waste water treatment processes.

The discharge end of the dewatering chamber 80 as shown in FIG. 1 is preferably equipped with a transfer seal 92 of the same construction as the transfer seal 34 illustrated in FIGS. 2 and 3 to facilitate pressurization of the preheated feed material and a compaction thereof to achieve maximum water extraction prior to discharge into the lower end of the reaction chamber 62. In addition, the interior wall of the mechanical dewatering chamber 80 as best seen in FIG. 5 is preferably provided with a plurality of circumferentially spaced grooves 94 which extend longitudinally therealong to facilitate longitudinal transfer of the feed material and to minimize slippage in response to rotation of the screw conveyor 82. The use of the grooves 94 can also be advantageously embodied in the feed extruder 24, preheating chamber 54 and reaction chamber 62 to facilitate conveyance of the feed material therethrough.

The dewatered material enters the reaction chamber 62 through a transfer seal 92 and is conveyed upwardly therethrough by means of a screw-type conveyor 96 drivingly coupled to a variable speed drive system 98. The reaction chamber 62 is provided with an insulated jacket 100 for heating the feed material therein to a preselected elevated temperature which is controlled to achieve the desired thermal reaction depending upon the particular type of feed material being processed and the characteristics of the reaction product desired.

The temperature and pressure within the reaction chamber 62 or stage are controlled within a range of about 400° up to about 1200° F., and preferably from about 500° to about 1000° F. with pressures ranging from about 300 to about 3000 pounds per square inch (psi), and preferably from about 600 to about 1500 psi. The specific temperature and pressure employed will vary depending upon the specific type of feed material being processed and the desired reaction product to be produced. The speed of conveyance through the reaction chamber 62 is controlled by the variable speed drive system 98 to rotate the screw conveyor 96 in order to provide a total residence time of as little as about one minute to as long as about one hour. The temperature, pressure and time relationship are interrelated so as to attain the desired degree of vaporization of the volatile substances in the feed material and a controlled chemical thermal restructuring of the organic carbonaceous material.

A heating of the carbonaceous feed material within the reaction chamber 62 can be conveniently achieved by introducing a preheated fluid or a combustible fuel-air mixture into the insulated jacket 100 through an inlet tube 102 disposed in communication with the upper end portion of the jacket 100. The heating medium is discharged through an outlet tube 104 connected to the lower end portion of the jacket 100 providing a countercurrent heat transfer flow. The supply of heated flue gas or fuel-air gas for combustion within the jacket 100 itself is controlled to provide the desired temperature of the feed stock to achieve the desired reaction.

The specific time, temperature and pressure relationship within the reaction chamber 62 will vary and is controlled to attain the desired product. Typically, the apparatus 200 as illustrated is applicable for drying various naturally occurring moist organic carbonaceous materials, such as peat, for example, to effect a removal of the predominant proportion of moisture therefrom; the thermal treatment of sub-bituminous coals, such as lignite, for example, to render it more suitable as a solid fuel; the production of activated chars or carbon products by subjecting such organic carbonaceous material to elevated pyrolysis temperatures, followed by an activation treatment; the pyrolysis of organic carbonaceous feed materials at elevated temperatures to effect a thermal cracking and/or degradation thereof into gaseous products producing a fuel gas; and the like. Conventionally, temperature, pressure and residence time conditions are employed to effect a mild wet pyrolysis of the organic carbonaceous material whereby substantially all of the residual moisture content thereof is vaporized in addition to at least a partial vaporization of volatile organic substances therein including those generated by thermal cracking and/or degradation of the feed material which form a gaseous phase comprised of substantially noncondensible gases as well as a condensible phase consisting predominantly of water.

By selection of appropriate operating conditions for the apparatus 200 illustrated in FIG. 1, a wet carbonization of moist organic carbonaceous feed materials can be effected such as peat or wood or other cellulosic materials whereby the reaction product comprises an upgraded solid carbonized fuel in further combination with a noncondensible gaseous by-product the composition of which will vary depending upon the severity of the pyrolysis treatment of the feed material in the reaction zone 62. Such gaseous by-product may comprise carbon dioxide, carbon monoxide as well as other organic gaseous constituents which are of a heating value sufficient to supply the thermal requirements of the operation of the apparatus 200. It has been observed that a significant fraction of the oxygen in the feed material is displaced whereby the heating value of the organic carbonaceous material treated, such as peat, for example, is increased in amounts of about 4,000 to about 5,000 Btu per pound in comparison to that of the feed material prior to treatment on a dry, moisture-free basis. For example, it has been found experimentally that peat, such as Canadian sphagnum peat processed in accordance with the arrangement illustrated in FIG. 1 provides a solid fuel having a heating value ranging from about 12,500 to about 13,500 Btu per pound with a sulfur content of less than 0.2 percent by weight at very low residual ash levels in comparison to a heating value of this same material prior to treatment of only about 7,000 to about 8,000 Btu per pound on a dry moisture-free basis.

The hot reaction gas generated in the reaction chamber 62 passes from the hot upper end portion toward the lower incoming section thereof in a countercurrent heat transfer relationship relative to the feed material whereby a progressive increase in temperature thereof is effected. The countercurrent flow of the reaction gas effects a transfer of the sensible heat from the noncondensable gaseous portion and a liberation of the heat of vaporization of the condensable gaseous portion to the dewatered feed material so that a predominant portion of the heat generated in the reaction zone 62 is recovered in the form of a further preheating of the incoming dewatered feed material in preheating chamber 54. In order to accomplish this, as shown and preferred, the residual gaseous phase comprising predominantly noncondensable gases and some condensable gases is withdrawn from the lower section of the reaction zone 62 through conduit 106 provided with a flow control valve 108 and is discharged into the preheating chamber 54 in countercurrent heat transfer relationship with the incoming feed material. In addition, the residual reaction gas containing an increased condensable portion is withdrawn from preheating chamber 54 in a manner as previously described through conduit 64 through control valve 66 and is advantageously introduced into the base of the feed hopper 22 in order to provide a preliminary preheating of the incoming feed material in those instances where the heat economy of the system 200 can be increased as a result of such preheating, such as where the input feedstock is peat having a starting moisture content in the 70–90 percent range. In instances where the heat economy of the system is not increased by such preliminary preheating, such as where the input feedstock is peat having a starting moisture content of less than 70 percent such as 50 percent, this preliminary preheating is preferably omitted. For example, when moist carbonaceous feed materials, such as peat are employed containing moisture contents of about 70 to 90 percent by weight, an initial preheating thereof within the feed hopper 22 by waste heated steam generated from the process as well as residual reaction gases to temperatures of about 190° to about 200° F. has been effective to cause an increase in the heat economy of the system 200. However, it has been noted that if the moisture content of the peat entering the feed extruder exceeds 70 percent by weight difficulties may occur in the operation of the feed extruder 24. It is further contemplated that a supplemental heating fluid such as steam can be supplied to the feed hopper 22 through a conduit 110 provided with a flow control valve 112 in the event the residual gaseous phase and waste steam generated is inadequate to attain the desired preliminary preheating temperature.

It has been determined experimentally, that a compaction of the feed material upon passing through the feed extruder 24 will provide some extraction of initial moisture from the feed material even though no preliminary preheating thereof is effected in the feed hopper. Moreover, as stated above, this preliminary preheating is of general heat conservation benefit and, thus, is preferably omitted where such benefit will not occur. The quantity of moisture extracted in the feed extruder 24 will vary depending upon the initial moisture content of the feed stock and the nature thereof. For example, a particulated wood product at room temperature is reduced to a residual moisture content of about 28 percent upon passing through the feed extruder 24. When the carbonaceous feed material comprises peat, a reduction in moisture by the feed extruder 24 to a level of about 70 percent residual moisture is attained. If the peat feed stock contains 50 percent initial moisture, substantially no water extraction is attained in the feed extruder 24. If the peat feed stock contains about 75 percent initial moisture, the feed extruder 24 effects an extraction of moisture down to a level of about 70 percent by weight. At higher moisture contents such as 90 percent moisture, the peat feed stock at room temperature is reduced to a level of about 70 percent moisture upon passing through the feed extruder 24, although difficulties may occur in the operation of the feed extruder 24.

When a peat feed stock is preliminarily preheated in the feed hopper 22 such as by the introduction of steam and hot residual reaction gases in heat transfer relationship therewith, the condensation of the condensable gaseous portion results in an increase in the moisture content of the incoming feed above that initially present. The moisture level is again reduced during passage through the feed extruder 24 to a level of about 70 percent as in the case of the room temperature feed stock but with the significant advantage of conserving energy and a recovery of heat value in the several exhaust streams.

The partially dewatered feed stock is further heated in the preheating chamber 54 to temperatures generally up to about 500° F. and further moisture is extracted upon passage of the preheated feed material through the dewatering chamber 80 to a residual level of about 15 to about 30 percent by weight, preferably less than about 15 percent by weight. It is generally desirable to retain a small percentage of moisture in the feed stock entering the reaction chamber such as a level of about 5 to about 15 percent by weight to enhance the thermal pyrolysis of the carbonaceous material in the reaction chamber. When the carbonaceous feed material comprises peat, the preheating chamber 54, in effect, forms another reaction chamber in which the peat feed stock conveyed thereto is heated to a temperature, such as about 300° to about 400° F., by way of example, sufficient to cause a change in the physical characteristics of the peat so as to enable the moisture content of the peat conveyed to the dewatering chamber 80 to be reduced to about 28 percent by weight. Without such a change in physical characteristics due to the heating of the peat in chamber 54, it has been found that further moisture cannot be extracted in the dewatering chamber 80 from peat supplied to the inlet thereof at a moisture content of approximately 50 percent by weight. This could have a significant impact on the efficiency and output capacity of the system 200. As was previously mentioned, the necessary heat to cause this reaction in chamber 54 can be supplied through a recovery of the heat of vaporization from reaction chamber 62 via countercurrent gas flow through pipe 106.

In accordance with the arrangement shown in FIG. 1, the hot reaction product upon emergence from the upper end of the reaction chamber 62 passes through a discharge conduit 114 and is conveyed by a screw conveyor 116 drivingly coupled to a variable speed drive system 118 downwardly into an extruder 120. The extruder 120 is provided with a screw-type conveyor 122 drivingly coupled to a variable speed motor drive 124. A compaction of the hot reaction product occurs in the extruder 120 which upon passage through an extrusion orifice 126 in the form of a substantially dense mass forms a self-sustaining seal preventing an escape of pressure from the interior of the reaction system. The speed of rotation of the screw conveyors 116,122 can be varied in accordance with the rate at which the reaction product emerges from the reaction chamber 62 to assure the maintenance of a proper pressure seal in the extrusion orifice 126. It is also contemplated that a transfer seal, such as transfer seals 34 or 92 previously described in connection with FIGS. 2 and 3, can be employed for preventing loss of pressure from the system. Similarly, a ram-type extruder such as the extruder of FIG. 4, can be employed in place of the screw-type conveyor 122. In accordance with a preferred practice, the extrusion orifice 126 is in the form of a conventional lock-hopper for retaining the discharged reaction product and transferring it to atmospheric pressure through a conduit 128 into a cooler 130.

The hot reaction product entering the cooler 130 is contacted with a cooling medium under a protective non-oxidizing atmosphere to a temperature at which it can be discharged into contact with the atmosphere without adverse effects. When the reaction product is at an elevated temperature, a suitable liquid such as water can be introduced into the cooler through a conduit 132 equipped with a flow control valve 134 whereby the water is converted to the gaseous phase and is exhausted through a steam vent 136. The cooled reaction product upon emergence from the cooler 130 can be further comminuted, pelletized, agglomerated and the like, if desired, for producing particles of the desired size. It is also contemplated that the hot reaction product can be pelletized, comminuted, agglomerated or the like prior to cooling depending on the specific characteristics of the reaction product to facilitate handling thereof and optimize the formation of aggregates or particles of the desired physical properties. Generally, such pelletizing, for example, may occur in the extruder 120. However, it has been found that in certain instances the properties of the input feedstock may be such that a separate pelletizing device, such as a pelletizing extruder, may be required in addition to extruder 120 in order to accomplish the desired pelletizing. For example, if the input feedstock is peat, and the reaction product input to extruder 120 is of such a nature that it cannot be efficiently pelletized in extruder 120, such as if it is too fine or is not self-agglomerating, then a separate pelletizing extruder would preferably be employed after the cooler 130, and extruder 120 would function essentially as a pressure let-down device. It is also contemplated that binding and/or additive agents of the types well known in the art can be mixed with the reaction product to produce the desired end product.

The arrangement as illustrated schematically in FIG. 1 is the so-called "Off-Axis System" in which the longitudinal axes of each of the screw conveyors of the preheating chamber 54, dewatering chamber 80 and reaction chambers 62 are offset and are rotated by a separate drive motor system. By virtue of the reduction in initial moisture content to a level as low as about 15 percent to about 25 percent by weight prior to entering the reaction chamber, an increase in capacity of the apparatus 200 is attained in a range of at least from about 200 to about 300 percent assuming a feed material such as peat having an initial moisture content of about 50 percent by weight.

It has been found that for certain carbonaceous feed materials such as high moisture containing peat, for example, improved efficiency in the extraction of water can be achieved employing a reciprocating piston or ram in lieu of a screw-type conveyor in the dewatering chamber 80. With reference to FIG. 4 of the drawings, a satisfactory ram-type extruder 138 is schematically illustrated incorporating a tubular cylindrical housing 140 in which a piston or ram 142 is reciprocably mounted and is reciprocable by means of a rod 144 connected to a fluid actuated cylinder 146. The preheated feed material is adapted to enter the cylindrical housing through an inlet port 148 and is advanced and compacted in a direction toward the right as viewed in FIG. 4 by movement of the ram 142 from the position as shown in solid lines to the advanced position as shown in phantom. During the compaction stroke, water is extracted from the feed material which is separated and withdrawn through a perforated screen such as a Johnson-type screen 150 which is withdrawn through a flow control valve 152 and treated in a manner as previously described in connection with FIG. 1. The forward or right hand end of the cylindrical housing 140 is connected to a suitable transfer seal such as the seal 92 of FIG. 1 of a construction as previously described in connection with FIGS. 2 and 3 to facilitate a compaction of the feed material. The frictional engagement of the compacted feed material forwardly of the face of the piston 142 retains the material in place during the retracting stroke of the piston.

"ON-AXIS SYSTEM"

Figures 6, 7:
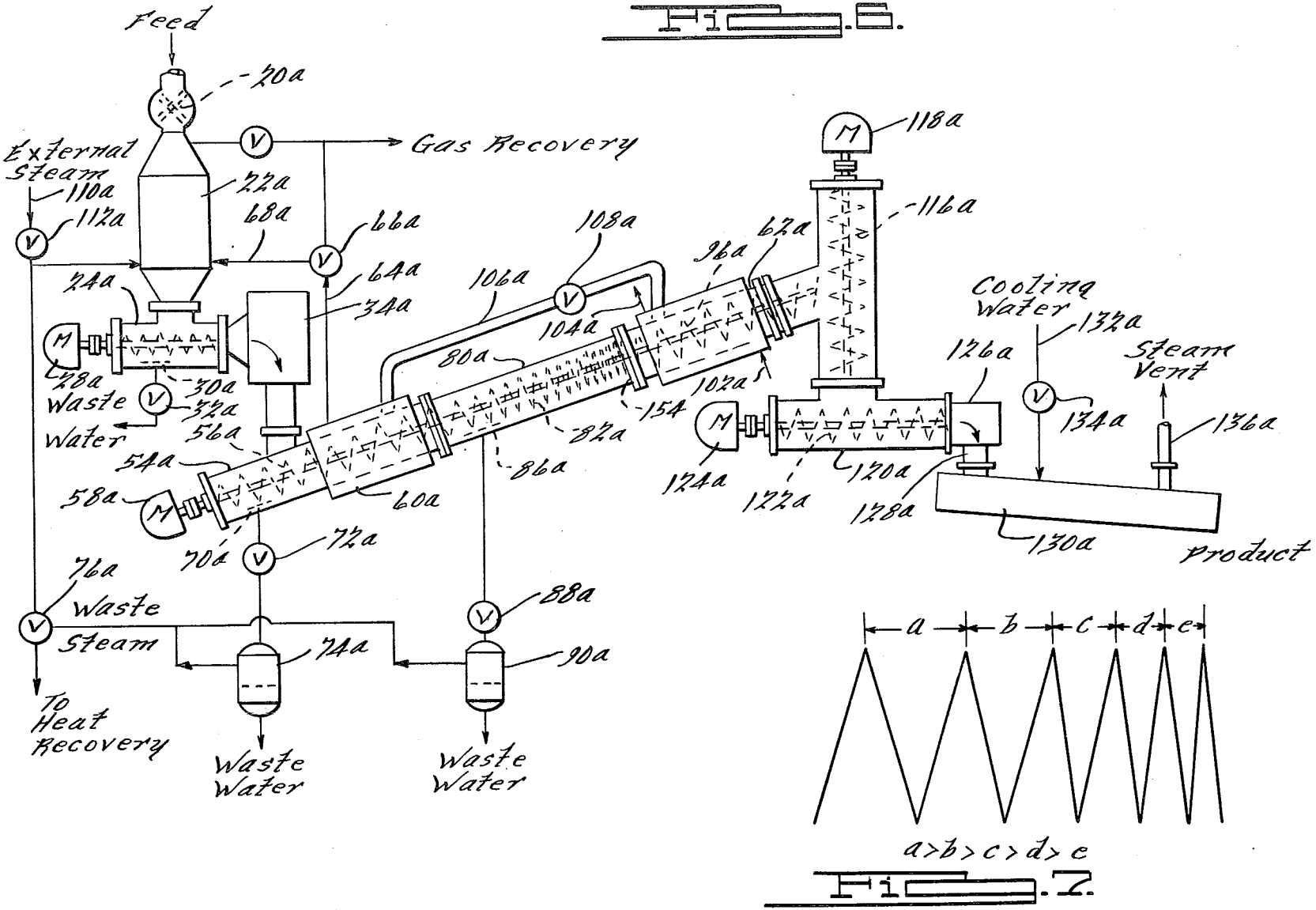
FIG. 6 is a schematic side elevational view of a continuous reaction apparatus in accordance with an alternative satisfactory embodiment of the present invention in which the several chambers are axially aligned.
FIG. 7 is a graphic illustration of the reducing lead screw conveyor in the mechanical dewatering section of the apparatus illustrated in FIG. 6.

An alternative satisfactory embodiment to the apparatus illustrated in FIG. 1 and as hereinbefore described is illustrated in FIG. 6 in Which the rotary screw conveyors in the preheating chamber, mechanical dewatering chamber and in the reaction chamber are all disposed on a common axially extending shaft. In the apparatus of FIG. 6, components common to those of the apparatus of FIG. 1 have been designated by the same numeral with a suffix letter "a" appended thereto. As previously described in connection with FIG. 1, the feed material from the feed hopper 22*a* is transferred by the feed extruder 24*a* into the preheating chamber 54*a* and into the dewatering chamber 80*a*. The coaxial alignment of the dewatering chamber with the reaction chamber 62*a* obviates the need for a transfer seal 92 as employed in the apparatus of FIG. 1 and pressurization and compaction of the preheated feed material in the dewatering chamber is effected by employing a screw conveyor 82*a* having a progressively decreasing lead or pitch on moving toward the outlet end thereof in further combination with a perforated plate 154 interposed between the dewatering chamber 80*a* and the inlet of the reaction chamber 62*a*.

By way of example, the screw conveyor 82*a* is provided with a progressively reduced pitch as graphically illustrated in FIG. 7 in which the respective leads are represented by letters a, b, c, d, e, etc. Accordingly, assuming a 24 inch diameter screw of an overall length of about 7 feet, the leads or pitch are preferably reduced in increments of about 4 inches so as to provide a lead or pitch of 24 inches, 20 inches, 16 inches, 12 inches, 8 inches, and 4 inches. The provision of a perforated plate at the exit end of the dewatering chamber 80*a* further provides for an increase in the pressure or compaction exerted on the preheated feed material optimizing the extraction and separation of entrapped and chemically combined water therefrom. A continuous wiping action of the downstream face of the perforated plate 154 is achieved by the leading edge of the screw conveyor 96*a* in the reaction chamber 62*a* disposed adjacent thereto applying a cutting or wiping action to dislodge the dewatered feed material passing through the perforations therethrough. In other structural and operating aspects, the apparatus of FIG. 6 is substantially identical to the structural aspects and operating parameters as previously described in connection with the apparatus of FIG. 1.

Figure 8:
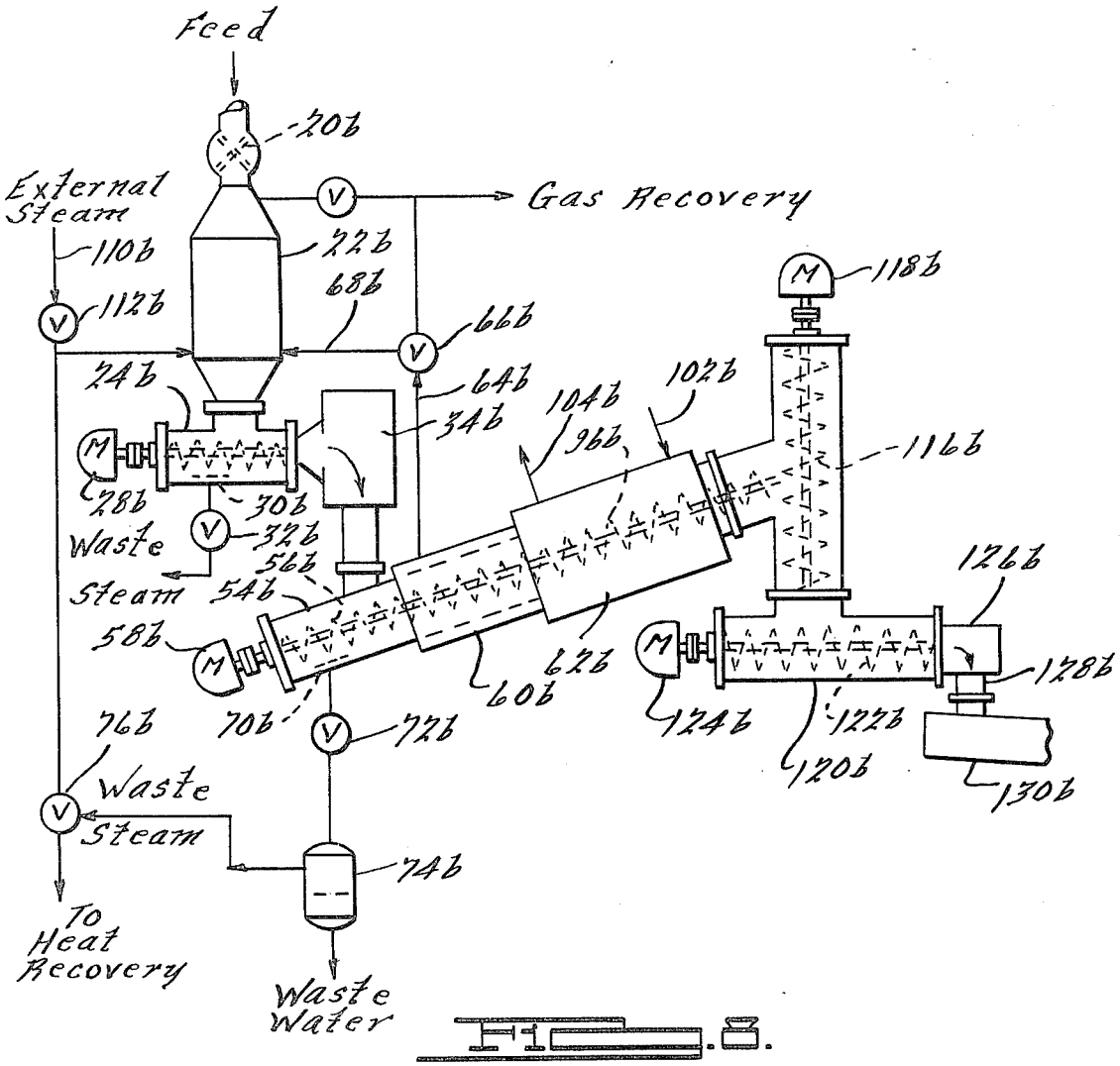
FIG. 8 is a schematic side elevational view of a continuous reaction apparatus constructed in accordance with still another alternative embodiment of the present invention.

Still another alternative satisfactory embodiment of the present invention is illustrated in FIG. 8 which is of a construction similar to that shown in FIG. 6 but devoid of any mechanical dewatering section. Similar components of the apparatus in FIG. 8 have been designated by the same numerals employed in FIG. 6 with a suffix letter "b" affixed thereto. The arrangement of the preheating chamber **54*b* and reaction chamber 62*b* are on an "On-Axis" system whereby a common screw-type conveyor 56*b*,96*b* extends for the length of the sections and is driven by a single variable speed drive system 58*b*. In the embodiment illustrated in FIG. 8, a preliminary extraction of moisture from the incoming feed material is achieved solely as a result of a preheating of the moist feed in the feed hopper 22*b* in a manner as previously described whereby an extraction thereof occurs in the feed extruder 24*b* through a perforated screen 30*b* and valve 32*b* and a second extraction thereof occurs in the conveying zone of the preheating chamber 54*b* which is removed through a perforated screen 70*b* and valve 72*b* to a steam separator 74*b*. A countercurrent heating of the feed material as it is advanced upwardly through the preheating 54*b* and reaction chambers 62*b*occurs by a countercurrent flow of the reaction gases produced in the reaction chamber 62*b* which moves downwardly through the feed material in heat transfer relationship therewith and the gases are extracted through a conduit 64*b* at an upstream portion for use in a manner as previously described. In accordance with the arrangement of FIG. 8, a preheating of the feed material in the feed hopper 22*b* and subsequent extraction of moisture in the feed extruder 24*b* and preheating chamber 54*b* is operative to reduce the moisture content of the feed material to a level of about 30 percent by weight or less at the time it enters the reaction chamber 62*b***.

In accordance with the process aspects of the present invention, moist organic carbonaceous materials are introduced and subjected to a sequence of steps to effect a controlled extraction of the initial moisture content therein and a controlled preheating thereof prior to introduction into the reaction chamber which is maintained within a controlled pressure range at a controlled elevated temperature for a preselected residence time to achieve a desired vaporization of volatile constituents and a controlled thermal restructuring of the material to produce a useful product. The specific processing parameters and conditions employed will vary depending upon the specific type of carbonaceous feed material being treated and the desired characteristics of the final reaction product produced.

The process and apparatus of the present invention is applicable for processing a variety of carbonaceous feed materials of the types heretofore described which generally have an initial moisture content ranging from about 25 to about 90 percent by weight, preferably about 40 to about 70 percent by weight with a percent of about 50 being typical. A preheating of the feed material in the storage hopper can be performed from about ambient temperature up to about 210° F. at a pressure of about atmospheric. In the preheating chamber of the apparatus, the moisture content of the feed material can broadly range from about 25 to about 90 percent by weight, preferably from about 30 to about 70 percent by weight with a moisture content of about 40 percent by weight being typical. A preheating of the feed material in the preheating chamber can range from about 300° to about 500° F., preferably from about 300° to about 400° F. and typically about 390° F. The pressure in the preheating zone can range from about 100 to about 1600 psi, preferably about 500 to about 800 psi with a pressure of about 750 psi being typical. The moisture content of the feed material discharged from the preheating chamber will generally range from about 30 to about 90 percent by weight, preferably from about 30 to about 70 percent by weight with a moisture content of about 60 percent by weight being typical. The residence time of the feed material in the preheat chamber can range from about 3 minutes to about one hour.

The particular moisture contents, temperatures, pressures, and residence times comprising the processing parameters in the several stages of the system will vary in consideration of the source, type and characteristics of the feed material, its initial moisture content and the characteristics of the final reaction product desired. Accordingly, the foregoing process parameters are adjusted to optimize processing efficiency and product characteristics.

The feed material transferred from the preheating chamber to the mechanical dewatering chamber will be of a temperature generally corresponding to that of the outlet end of the preheating chamber with an operating pressure of the same general range. Upon exiting of the mechanical dewatering zone, the moisture content of the dewatered feed material will range from about 12 to about 30 percent by weight, preferably about 15 to about 25 percent by weight with a residual moisture content of about 20 percent by weight being typical. The dewatered feed material at the temperature and pressure and of a moisture content corresponding to that discharged from the dewatering zone is heated in the reaction chamber to a temperature of about 500° to about 1200° F., preferably from about 600° to about 800° F. with a temperature of about 750° F. being typical. The pressure in the reaction zone may range from about 500 to about 2000 psi, preferably about 600 to about 1600 psi with a pressure of about 800 psi being typical. The residence time in the reaction chamber can range from about 3 minutes up to about one hour, with residence times of about 5 to about 10 minutes being preferred. The moisture content of the reaction product discharged will generally range from about 0 to about 10 percent by weight depending upon the severity of the reaction conditions.

As was previously mentioned, when the carbonaceous feed material comprises peat, the preheating chamber, in effect, forms another reaction chamber in which the preheated feed stock conveyed thereto is heated to a temperature sufficient to cause a change in the physical characteristics of the peat so as to enable the moisture content of the peat conveyed to the dewatering chamber to be reduced from about 15 to about 30 percent by weight. Typically, the temperature required to cause such a change in physical characteristics is in the range of 300° F. to 400° F. Moreover, for peat feedstock having a starting moisture content in excess of 50 percent by weight, such as 70 to 90 percent by weight in the process of the present invention, it has been found that the heat economy of the system is increased if the peat in the feed hopper undergoes a preliminary preheating, typically to a temperature in the range of 190° F. to 200° F., such as by waste heated steam and/or residual reaction gases produced in the process.

In order to further illustrate the process aspects of the present invention, the following specific examples are provided for illustrative purposes and are not intended to be limiting of the scope of the present invention as herein described and as set forth in the subjoined claims.

EXAMPLE 1

A North Carolina peat containing nominally about 50 percent by weight moisture is employed as a feed material to produce a high volatile content solid reaction fuel product. The proximate and ultimate analyses of the feed material and the final reaction product are set forth in Table 1.

TABLE 1

PROXIMATE AND ULTIMATE ANALYSES OF FEED MATERIAL AND PRODUCT

| | Raw Peat | Reaction Product |
|---|---|---|
| Proximate Analysis (dry basis) | | |
| Volatiles wt % | 57.06 | 40.60 |
| Fixed carbon wt % | 35.33 | 49.41 |
| Ash wt % | 7.61 | 9.99 |
| Gross heating value Btu/lb-dry basis | 9315 | 11,353 |
| Ultimate Analysis (dry basis) | | |
| Carbon | 55.15 | 65.85 |
| Hydrogen | 4.45 | 3.73 |
| Sulfur | 0.17 | 0.20 |
| Nitrogen | 1.29 | 1.74 |
| Oxygen | 31.33 | 18.49 |
| Ash | 7.61 | 9.99 |

The processing of the feed material under the process parameters as hereinafter set forth resulted in a yield of about 74 percent by weight of reaction product based on the dry weight of the feed material introduced. The general process arrangement corresponds to that as illustrated in FIG. 1 of the drawings with the exception that a ram extruder is employed in lieu of the dewatering screw conveyor 80 of the general type as illustrated in FIG. 4 and a pelletizing extruder is employed following the cooler 130 of FIG. 1 to effect a pelletizing of the reaction product into pellets of the desired size.

A moist North Carolina peat feed material of a composition as set forth in Table 1 is transferred to the feed hopper 22 of FIG. 1 at ambient temperature (about 60° F.) at atmospheric pressure at a flow rate of about 9326 pounds per hour on a dry basis containing a corresponding amount of moisture at a 50 percent moisture content. The feed material is pressurized upon passing through the feed extruder 24 to a nominal pressure of about 400 psi and the frictional heating occurring raises its temperature to about 80° F. The pressurized feed material enters the preheating chamber 54 in which it is preheated to a temperature of about 400° F. at a pressure of 400 psi as a result of the countercurrent contact with gaseous reaction products from the reaction chamber at a temperature of about 508° F. and at a pressure of about 800 psi. A portion of the condensible moisture content in the preheating gaseous heating medium causes an increase in the moisture content of the feed material from a level of 9326 pounds to 13087 pounds. The preheated peat feedstock thereafter passes through the dewatering chamber 80 in which it is compacted producing a dewatered peat intermediate feed at a temperature of about 400° F. and a pressure of about 800 psi containing 9326 pounds peat on a dry solid basis and 3109 pounds retained moisture.

The dewatered intermediate feed material is transferred into the reaction chamber 62 for a retention time of about ten minutes at a pressure of 800 psi with the walls of the reactor heated by a Syltherm heat exchange medium to a temperature of from about 750° to about 800° F. The feed material on being advanced axially through the reaction chamber is progressively heated to about 500° F. and is retained at that temperature until substantially all of the moisture content thereof evaporates whereafter the temperature progressively increases to about 600° F. during the latter two minutes of residence time in the output section of the reactor as the material is discharged through a pressure let-down device such as a reciprocating ram to the cooler 130. The reaction product prior to cooling comprises about 6900 pounds of substantially dry material at a temperature of about 600° F. and at atmospheric pressure. A cooling of the reaction product is effected by spraying fresh cold water in heat exchange contact therewith to effect a cooling thereof to a temperature of about 200° F. with a pickup of about 345 pounds of moisture. After cooling, the cooled reaction product is pelletized such as by employing a suitable pelletizing extruder at a temperature of about 150° F. and atmospheric pressure to produce 6900 pounds reaction product containing about 345 pounds moisture.

In the foregoing example, the peat following preheating and dewatering is reduced to a residual moisture content of about 25 percent by weight prior to entering the reaction chamber. When employing peat feed materials of a moisture content in excess of about 70 percent by weight, the moisture in excess of about 70 percent by weight is extracted during the feed extrusion of the material with or without preliminary preheating in the feed hopper and the remaining moisture content down to a residual level of from about 15 to about 30 percent by weight is removed in the dewatering extruder or ram following preheating. Nominally, the moisture content of such feed material regardless of initial moisture content is about 25 percent prior to entry into the reaction chamber 62.

EXAMPLE 2

A particulated cellulosic feed material comprising waste soft woods from trees of the State of Maine comprising bark, sawdust, chips, etc. of a nominal moisture content of about 70 percent by weight is introduced into the feed hopper 22 of FIG. 1 at ambient temperature (about 60° F.) and atmospheric pressure. The feed material is compacted in the feed extruder 24 in a manner to increase its pressure to about 400 psi and the moisture content thereof is reduced to about 28 percent by weight. The extracted moisture is removed from the feed through the screen 30 as shown in FIG. 1 and the partially dewatered feed material is transferred to the preheat chamber. The feed material is heated in the preheat chamber to a temperature up to about 450° F. at a pressure of 800 psi by countercurrent contact with the gaseous phase from the reaction chamber wherein a portion of the moisture condensing therein causes an increase in net moisture content to about 30 percent by weight.

The preheated waste wood thereafter is passed through a dewatering chamber employing a ram-type extruder in which it is compacted in a manner so as to reduce its moisture content to about 25 percent by weight. In this condition, the dewatered feed material enters the reaction chamber in which it is heated at a pressure of about 800 psi and at a temperature ranging from about 500° to about 700° F. for a period of about 10 minutes residence time to effect a controlled thermal chemical restructuring thereof. By raising the temperature within the reaction zone from about 500° up to about 700° F., a greater quantity of combustible gases are produced due to the increased severity of the pyrolysis reaction and which gases can be employed to supply heat for heating the reactor and ancillary equipment.

The resultant reaction product is transferred from the reaction chamber through a pelletizing extruder in which the reaction product is formed into pellets at a temperature of about 700° F. and at a final pressure of atmospheric whereafter the pellets are transferred to the cooler 130 of FIG. 1 and are contacted by fresh cool water to effect a cooling thereof to about 200° F. with a residual moisture content of about 5 to 10 percent by weight.

It will be appreciated that when waste wood feed materials are employed containing initial moisture contents ranging from as low as about 40 percent to as high as about 90 by weight, the residual moisture content of the wood feed after passing through the feed extruder is reduced in all cases to about 28 percent moisture. Following the preheating and dewatering stage, the feed material prior to entering the reaction chamber in all cases is reduced to about 15 to 30 percent by weight, typically about 25 percent by weight.

While it will be apparent that the preferred embodiments of the invention disclosed are well calculated to fulfill the objects above stated, it will be appreciated that the invention is susceptible to modification, variation and change without departing from the proper scope or fair meaning of the subjoined claims.

What is claimed is:

1. An apparatus for thermal treatment of moist organic carbonaceous materials containing about 25 percent to about 90 percent by weight moisture under pressure comprising (a) means defining a preheating chamber having an inlet and an outlet spaced from said inlet, (b) supply means for introducing a moist organic carbonaceous feed material under pressure into said inlet, (c) means for conveying the feed material through said preheating chamber from said inlet to said outlet, (d) means for preheating the feed material in said preheating chamber to extract water therefrom, (e) means for separating and draining the extracted water from said preheating chamber, (f) means defining a dewatering chamber formed with an inlet port disposed in communication with said outlet of said preheating chamber and an outlet port spaced from said inlet port, (g) means for conveying and compacting the preheated feed material through said dewatering chamber to said outlet port to extract additional moisture therefrom, forming a dewatered feed material, (h) means for separating and draining the extracted water from said dewatering chamber, (i) means defining a reaction chamber formed with an entry port disposed in communication with said outlet port for receiving the dewatered feed material from said dewatering chamber and a discharge port spaced from said entry port, (j) means for heating the feed material in said reaction chamber to an elevated temperature for a period of time sufficient to vaporize at least a portion of the volatile substances therein to form a gaseous phase and a reaction product, (k) means for conveying the feed material through said reaction chamber and for discharging the reaction product through said discharge port, (l) means for separating and extracting the gaseous phase from said reaction chamber, and (m) means defining a receiving chamber disposed in communication with said discharge port for receiving the reaction product.

2. An apparatus in accordance with claim 1 wherein said moist organic carbonaceous material comprises peat, said preheating chamber comprising a reaction chamber for changing the physical characteristics of said peat introduced thereto as a result of said preheating of said peat in said preheating chamber, said means for preheating the peat feed material in said preheating chamber comprising means for preheating said peat to a temperature sufficient to cause a change in the physical characteristics of said peat which enables the moisture content of the peat conveyed through said dewatering chamber to the outlet thereof to be substantially reduced to a lower level from the level of the moisture content of the peat supplied to the inlet to said dewatering chamber.

3. An apparatus in accordance with claim 2 wherein said preheating temperature is substantially in the range of about 300° F. to about 400° F.

4. An apparatus in accordance with claim 3 wherein the moisture content of said peat at the inlet to said dewatering chamber is about 50 to about 70 percent by weight.

5. An apparatus in accordance with claim 4 wherein said substantially reduced lower level of moisture content of said peat at the outlet of said dewatering chamber is about 15 to about 30 percent by weight.

6. An apparatus in accordance with claim 5 wherein said means for preheating the peat feed material comprises means for providing a countercurrent gas flow connected between said reaction chamber and said preheating chamber for recovering the heat of vaporization from said reaction chamber for providing said sufficient preheating temperature for said peat in said preheating chamber.

7. An apparatus in accordance with claim 6 wherein said supply means for said peat comprises feed hopper means for storing said peat prior to said introduction thereof to said preheating chamber inlet and means for preliminarily preheating said stored peat to a temperature sufficient to enhance the heat economy of the apparatus.

8. An apparatus in accordance with claim 7 wherein said peat stored in said feed hopper means has a starting moisture content in excess of about 50 percent by weight.

9. An apparatus in accordance with claim 8 wherein said stored peat starting moisture content is in excess of about 70 percent by weight.

10. An apparatus in accordance with claim 9 wherein said stored peat starting moisture content is in the range of about 70 to about 90 percent by weight.

11. An apparatus in accordance with claim 9 wherein said sufficient preliminary preheating temperature is in the range of about 190° F. to about 200° F.

12. An apparatus in accordance with claim 11 wherein said means for preliminarily preheating said stored peat comprises means for providing a countercurrent gas flow of residual gas from said preheating chamber to said feed hopper means.

13. An apparatus in accordance with claim 2 wherein the moisture content of said peat at the inlet to said dewatering chamber is about 50 to about 70 percent by weight.

14. An apparatus in accordance with claim 12 wherein said substantially reduced lower level of moisture content of said peat at the outlet of said dewatering chamber is about 15 to about 30 percent by weight.

15. An apparatus in accordance with claim 13 wherein said means for preheating the peat feed material comprises means for providing a countercurrent gas flow connected between said reaction chamber and said preheating chamber for recovering the heat of vaporization from said reaction chamber for providing said sufficient preheating temperature for said peat in said preheating chamber.

16. An apparatus in accordance with claim 2 wherein said substantially reduced lower level of moisture content of said peat at the outlet of said dewatering chamber is about 15 to about 30 percent by weight.

17. An apparatus in accordance with claim 2 wherein said means for preheating the peat feed material comprises means for providing a countercurrent gas flow connected between said reaction chamber and said preheating chamber for recovering the heat of vaporization from said reaction chamber for providing said sufficient preheating temperature for said peat in said preheating chamber.

18. An apparatus in accordance with claim 2 wherein said supply means for said peat comprises feed hopper means for storing said peat prior to said introduction thereof to said preheating chamber inlet and means for preliminarily preheating said stored peat to a temperature sufficient to enhance the heat economy of the apparatus.

19. An apparatus in accordance with claim 18 wherein said peat stored in said feed hopper means has a starting moisture content in excess of about 50 percent by weight.

20. An apparatus in accordance with claim 19 wherein said stored peat starting moisture content is in excess of about 70 percent by weight.

21. An apparatus in accordance with claim 20 wherein said sufficient preliminary preheating temperature is in the range of about 190° F. to about 200° F.

22. An apparatus in accordance with claim 21 wherein said means for preliminarily preheating said stored peat comprises means for providing a countercurrent gas flow of residual gas from said preheating chamber to said feed hopper means.

23. An apparatus in accordance with claim 18 wherein said means for preliminarily preheating said stored peat comprises means for providing a countercurrent gas flow of residual gas from said preheating chamber to said feed hopper means.

24. An apparatus in accordance with claim 23 wherein said sufficient preliminary preheating temperature is in the range of about 190° F. to about 200° F.

25. An apparatus in accordance with claim 2 wherein said dewatering chamber conveying and compacting means comprises a ram-type extruder means.

26. An apparatus in accordance with claim 17 wherein said dewatering chamber conveying and compacting means comprises a ram-type extruder means.

27. An apparatus in accordance with claim 18 wherein said dewatering chamber conveying and compacting means comprises a ram-type extruder means.

28. A process for the thermal treatment of organic carbonaceous materials containing about 25 percent to about 90 percent by weight moisture under pressure which comprises the steps of:

(a) introducing a supply of moist carbonaceous feed material to be processed under pressure into a preheating chamber and preheating the feed material to a temperature of about 300° to about 500° F. for a period of time and compacting the feed material to extract a portion of the water therein, (b) separating the feed material and the extracted water, (c) introducing the preheated feed material under pressure into a dewatering chamber and compacting the feed material to extract additional water therefrom, (d) separating the dewatered feed material from the water, (e) introducing the dewatered feed material under pressure into a reaction chamber and heating the feed material to a temperature of about 400° to about 1200° F. under pressure of about 300 to about 3000 psi for a period of time of about 1 minute to about 1 hour to vaporize at least a portion of the volatile substances therein to form a gaseous phase and a reaction product, (f) separating the gaseous phase from the reaction product, (g) and thereafter recovering and cooling the reaction product.

29. The process as defined in claim 28 including the further step of transferring the gaseous phase from step (f) into heat exchanging relationship with the feed material in the preheating chamber.

30. The process as defined in claim 29 including the further step of separating the gaseous phase from the preheated feed material in the preheating chamber and transferring the separated gaseous phase in heat exchange relationship with the feed material prior to introduction into the preheat chamber in a manner to effect a preliminary heating thereof.

31. A process for the thermal treatment of organic carbonaceous peat materials under pressure which comprises the steps of:

(a) introducing a supply of moist carbonaceous peat feed material to be processed under pressure into a preheating reaction chamber and preheating the peat feed material to a temperature of about 300° to about 500° F. for a period of time sufficient to cause a change in the physical characteristics of the peat feed material which enables the moisture content of the peat feed material conveyed from said preheating reaction chamber to be subsequently substantially reduced to a lower level;

(b) introducing the changed preheated peat feed material under pressure into a dewatering chamber and compacting the changed preheated peat feed material to extract sufficient water therefrom to reduce the moisture content of the peat feed material compact therein to said substantially reduced lower level;

(c) separating the dewatered peat feed material from the water;

(d) introducing the dewatered peat feed material under pressure into a reaction chamber and heating the introduced peat feed material to a temperature of about 400° to about 1200° F. under a pressure of about 300 to about 3000 psi for a period of time of about 1 minute to about 1 hour sufficient to vaporize at least a portion of the volatile substances therein to form a gaseous phase and a reaction product;

(e) separating the gaseous phase from the reaction product; and (f) thereafter recovering and cooling the reaction product.

32. The process as defined in claim 31 including the further step of transferring the gaseous phase from step (e) into heat exchanging relationship with the peat feed material in the preheating reaction chamber for providing said preheating temperature.

33. The process as defined in claim 32 wherein said preheating temperature is substantially in the range of 300° F. to 400° F.

34. The process as defined in claim 31 wherein said preheating temperature is substantially in the range of 300° F. to 400° F.

35. The process as defined in claim 34 including the further step of separating the gaseous phase from the preheated peat feed material in the preheating reaction chamber and transferring the separated gaseous phase in heat exchange relationship with the peat feed material prior to introduction into the preheating reaction chamber in a manner to effect a preliminary heating of the peat feed material and enhance the heat recovery of the process.

36. The process as defined in claim 35 wherein the temperature of the transferred separated gaseous phase for effecting said preliminary heating is substantially in the range of 190° F. to 200° F.

37. The process as defined in claim 32 including the further step of separating the gaseous phase from the preheated peat feed material in the preheating reaction chamber and transferring the separated gaseous phase in heat exchange relationship with the peat feed material prior to introduction into the preheating reaction chamber in a manner to effect a preliminary heating of the peat feed material and enhance the heat recovery of the process.

38. The process as defined in claim 37 wherein the temperature of the transferred separated gaseous phase for effecting said preliminary heating is substantially in the range of 190° F. to 200° F.

39. The process as defined in claim 31 including the further step of separating the gaseous phase from the preheated peat feed material in the preheating reaction chamber and transferring the separated gaseous phase in heat exchange relationship with the peat feed material prior to introduction into the preheating reaction chamber in a manner to effect a preliminary heating of the peat feed material and enhance the heat recovery of the process.

40. The process as defined in claim 39 wherein the temperature of the transferred separated gaseous phase for effecting said preliminary heating is substantially in the range of 190° F. to 200° F.

41. The process as defined in claim 31 wherein step (b) further includes the step of reducing the moisture content of the changed peat feed material in said dewatering chamber to a lower level of about 15 to about 30 percent by weight.

42. The process as defined in claim 41 including the further step of transferring the gaseous phase from step (e) into heat exchanging relationship with the peat feed material in the preheating reaction chamber for providing said preheating temperature.

43. The process as defined in claim 42 including the further step of separating the gaseous phase from the preheated peat feed material in the preheating reaction chamber and transferring the separated gaseous phase in heat exchange relationship with the peat feed material prior to introduction into the preheating reaction chamber in a manner to effect a preliminary heating of the peat feed material and enhance the heat recovery of the process.

44. The process as defined in claim 39 wherein the starting moisture content of the preliminarily heated peat feed material is in excess of 50 percent by weight.

45. The process as defined in claim 44 wherein said starting moisture content is in excess of 70 percent by weight.

46. The process as defined in claim 45 wherein said starting moisture content is in the range of about 70 to 90 percent by weight.

47. The process as defined in claim 41 wherein the moisture content of the changed peat feed material introduced into said dewatering chamber is about 50 percent by weight.

48. The process as defined in claim 31 wherein the moisture content of the changed peat feed material introduced into said dewatering chamber is about 50 to about 70 percent by weight.

* * * * *